US005257427A

United States Patent [19]

Hinshaw

[11] Patent Number: 5,257,427

[45] Date of Patent: Nov. 2, 1993

[54] ENCLOSURE APPARATUS FOR PROTECTING A PERSON AGAINST OUTDOOR EXPOSURE FACTORS

[76] Inventor: Jay M. Hinshaw, 604 S. Chester Ave., Bakersfield, Calif. 93304

[21] Appl. No.: 979,331

[22] Filed: Nov. 20, 1992

[51] Int. Cl.[5] ..... A47G 9/08

[52] U.S. Cl. ..... 5/613; 5/420; 2/69; 2/69.5

[58] Field of Search ..... 5/413, 417, 420; 2/69, 2/69.5, 89

[56] References Cited

U.S. PATENT DOCUMENTS

| | | | |
|---|---|---|---|
| 608,351 | 8/1898 | Terramorse | 2/89 |
| 4,989,282 | 2/1991 | Goldstein | 5/413 |
| 5,072,465 | 12/1991 | Lyons, Jr. | 5/413 |

FOREIGN PATENT DOCUMENTS

| | | | |
|---|---|---|---|
| 2516781 | 10/1976 | Fed. Rep. of Germany | 5/413 |
| 7809879 | 4/1980 | Netherlands | 5/413 |

*Primary Examiner*—Alexander Grosz
*Attorney, Agent, or Firm*—Charles C. Logan, II

[57] ABSTRACT

A multi-functional enclosure device made of four layers of compliant thin sheet material has an interior bag, and a surrounding exterior bag that opens at the bottom. Thermally insulative material can be inserted into the space between the two bags. Closeable slits disposed mid length form a portal for insertion of a user's head, thereby permitting the device to be folded upon itself and worn in a poncho mode. In other modes of use, the device can serve as a comforter or mattress, and a combined sleeping bag and bivouac shelter. When free of insulative material, the device can be compacted to a very small storage state.

8 Claims, 3 Drawing Sheets

ENCLOSURE APPARATUS FOR PROTECTING A PERSON AGAINST OUTDOOR EXPOSURE FACTORS

BACKGROUND OF THE INVENTION

1. Field of the Invention

This invention concerns protective apparatus, and more particularly relates to lightweight versatile apparatus for enhancing a person's comfort and survivability in an outdoor environment.

2. Description of the Prior Art

The use of sleeping bags, bivouac shelters and insulated wearing apparel for outdoor protective use are well known. In situations involving protracted periods of travel afoot in wilderness conditions, uncertainties exist concerning the weather and other environmental factors. From the standpoints of comfort and survivability, it would be desirable for such a traveler to have proper equipment to cope with all contingencies. However, the extent of preparedness must often be compromised by the amount of weight and bulk that an individual can carry.

Devices which provide a combination of outdoor protective functions have earlier been disclosed for use by campers, hikers and outdoorsmen. For example, U.S. Pat. Nos. 2,442,132 and 2,656,844 disclose combined sleeping bag and tent devices. Other multi-functional devices that may be used interchangeably as wearing apparel, mattress, sleeping bag or tent are disclosed in U.S. Pat. Nos. 3,958,274; 4,158,892; 4,347,629; 4,575,397 and 4,594,735.

In general, most outdoor protective devices require at least one barrier sheet, a layer of thermal insulation associated with said sheet, and interactive fittings to facilitate adjustability for different uses. The thermal insulation is usually a bulky substrate having entrapped air which prevents caloric transmission whether by conductive or convective mechanisms. Even efficient insulation material has bulk and weight. It has been disclosed in "Tom Brown's Field Guide to Wilderness Survival", Berkeley Publishing Company, 1983, that naturally occurring materials such as fallen leaves, conifer needles, moss, grass and forest debris can be accumulated and utilized as thermal insulation for shelter construction. In emergency situations such as those resulting from a tornado or aircraft crash, other insulation materials may be available such as fiberglass batting and foam cushioning material.

It is accordingly an object of this invention to provide a compact, light weight multi-functional device for protecting a person against environmental factors.

It is another object of this invention to provide a device as in the foregoing object which can utilize for thermal insulation naturally occurring materials such as forest debris, or debris such as fiberglass batting available in an emergency situation.

Other objects of the present invention are to provide a device of the aforesaid nature which is durable, easily interconvertible into several configurations, having different uses and amenable to low cost manufacture.

These and other beneficial objects and advantages will be apparent from the following description.

SUMMARY OF THE INVENTION

The above and other beneficial objects and advantages are accomplished in accordance with the present invention by an enclosure device comprised of four layers of compliant thin sheet material of substantially elongated rectangular perimeter defined by opposed side edges and first and second end edges, said layers disposed one above the other as upper and lower outer layers and upper and lower inner layers with said side and end edges in facing alignment, all layers being bonded together along their side edges and second end edges, the two facing first end edges of said inner layers being bonded together to constitute the bottom extremity of an interior bag having an open top extremity disposed upon said upper outer layer adjacent said end edges, the facing first end edges of said outer layers having closure means to constitute the bottom extremity of an exterior bag that completely surrounds said interior bag, said four layers having aligned sealable slits positioned parallel to and mid-way between said end edges and centrally disposed between said side edges.

The dimensions of the enclosure device are such that said interior bag can accommodate the entire height of a person in supine position. Drawstring means are preferably associated with the open top extremity of said interior bag. By virtue of such construction, the top extremity of the interior bag can be drawn snugly about the user's facial perimeter, as in a conventional mummy-type sleeping bag. The closure means for the bottom of said outer bag may be a zipper, buttons, snaps, contact adhesive tape, or VELCRO hook and loop fastening material.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the Figures of the drawing.

DESCRIPTION OF THE PREFERRED EMBODIMENT

Figure 1:
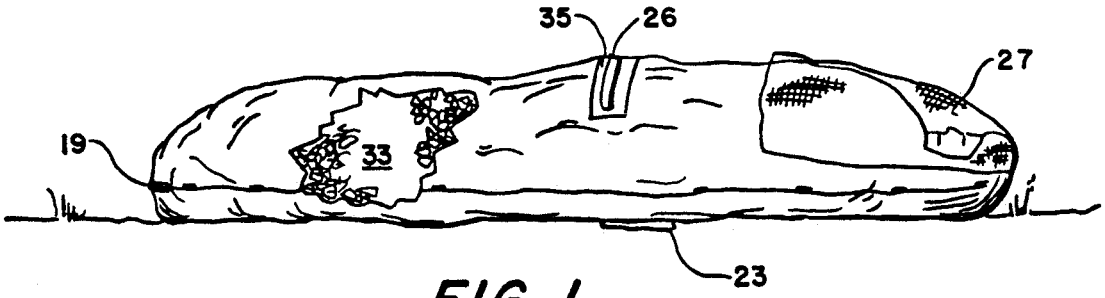
FIG. 1 is a side view of an embodiment of the enclosure device utilized as a combined sleeping bag and bivouac shelter.

Referring to FIGS. 1-7, an embodiment of the enclosure device of the present invention is shown comprised of upper and lower outer layers, 10 and 11, respectively, and upper and lower inner layers 12 and 13, respectively. Said layers are fabricated of compliant thin sheet material, suitable exemplary materials including nylon rip-stop fabric, coated fabrics, films, and film-fabric laminates. The layers are preferably impervious to wind and water, and may have thermally reflective surfaces such as may be produced by metalizing treatments.

Each of the aforesaid four layers has a substantially elongated rectangular perimeter defined by opposed side edges 14 and first and second end edges 15 and 16, respectively. The four layers are disposed one atop the other with said side and end edges in facing alignment. All four layers are joined together along side edges 14 and second end edges 16. The facing first end edges 15 of each inner layer are joined together to constitute the bottom extremity of interior bag 17.

An open top portal 18 to interior bag 17 is formed by way of aligned apertures in said upper outer layer and upper inner layer, said layers being bonded together about the perimeter of said apertures. First drawstring means 24 are associated with top portal 18. The facing first end edges 15 of said outer layers are provided with releasible closure means in the form of zipper 19, thereby constituting the bottom extremity of an exterior bag 20 that completely surrounds said interior bag.

Each layer has a releasible closed slit 21 of 7 to 20 inch length positioned parallel to and midway between said end edges and centrally disposed between said side edges. The slits, of equal length and aligned one above the other, are transversely disposed to a center line of symmetry 22 of the enclosure device. The upper outer layer can be releasibly engaged to the upper inner layer along both sides of said slits, and the lower outer layer can be likewise engaged to the lower inner layer along both sides of said slits. Such manner of engagement forms a centered portal 35 for insertion of the user's head in the poncho mode of use. Such releasible engagement may be achieved by strips of VELCRO hook and loop fastener material attached to the layers contiguous to said slits. A poncho-style hood 23, fabricated of the same sheet material as the several layers, and provided with second drawstring means 25, is attached to lower outer layer 11 adjacent portal 35. A sealing flap 26 may be attached to upper outer layer 10 adjacent slit 21.

In one of the several modes of use, the enclosure device may be employed as a combined sleeping bag and bivouac shelter, as shown in FIG. 1. In such mode of use, exterior bag 20 is filled with any available materials 33 which can provide thermal insulation and cushioning effect. Sealing flap 26 is caused to seal slit 21. The person then enters interior bag 17 via top portal 18 and draws said first drawstring means to secure the open top extremity snugly about his facial perimeter. This essentially provides a mummy-style sleeping bag. It is to be noted that in this manner of use, there is a single layer of insulation above and below the person. Protective flaps 27, which may be mosquito netting and/or impervious film material attached to upper outer layer 10 adjacent second end edge 16, may be brought forward to protect the person's face.

Figure 2:
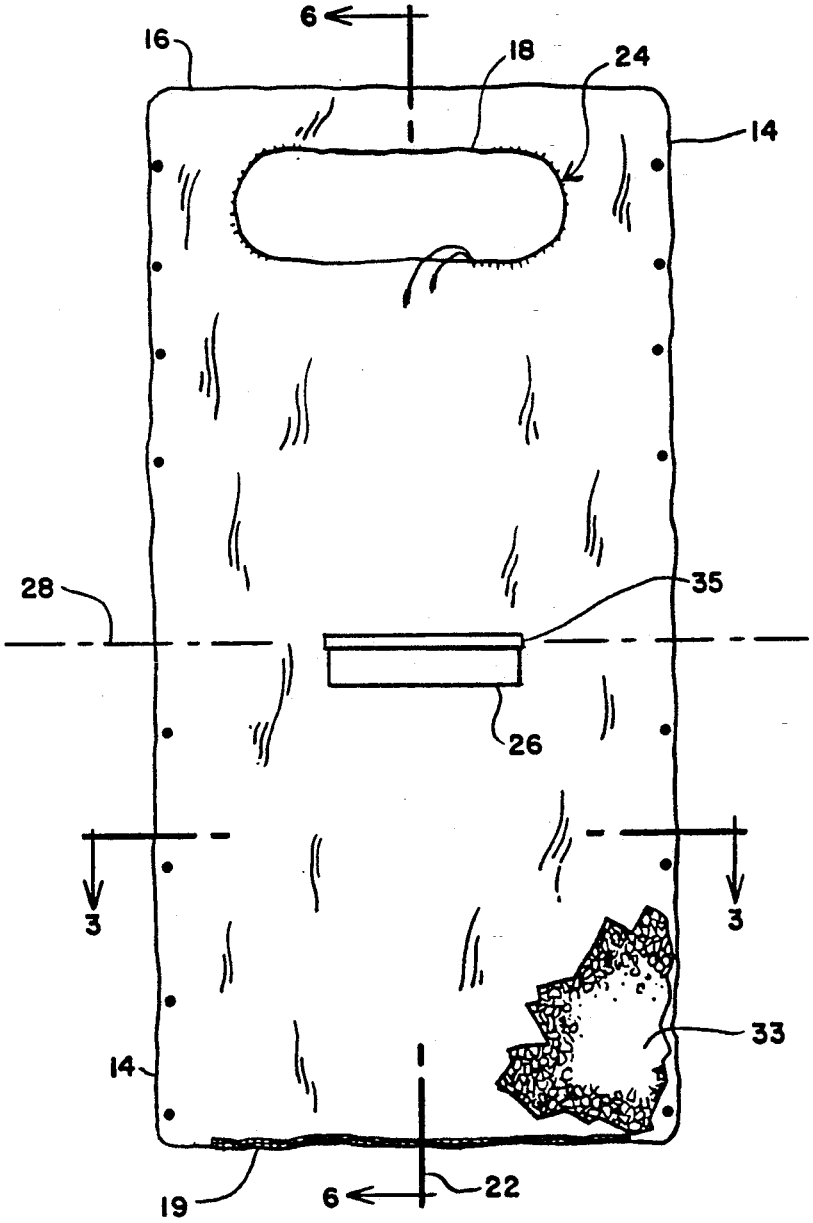
FIG. 2 is a top plan view of the device of FIG. 1 with portions cut away to reveal interior details.
Figure 3:
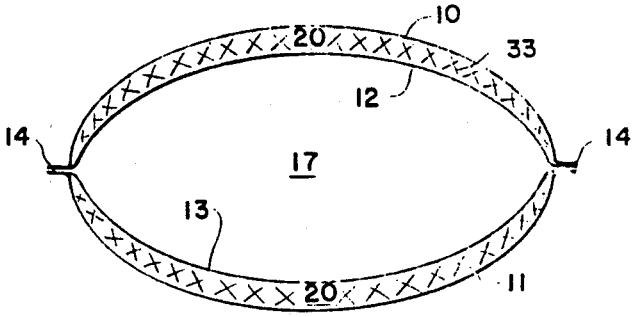
FIG. 3 is a sectional view taken in the direction of the arrows upon line 3—3 of FIG. 2.

In a second mode of use, as shown in FIG. 2, the device when suitably filled may be employed simply as a mattress. In such a manner of use, it is to be noted that the person lying upon the mattress has two layers of insulation beneath him. Similarly, the device may be disposed above a reclining person to serve as a blanket.

Figure 4:
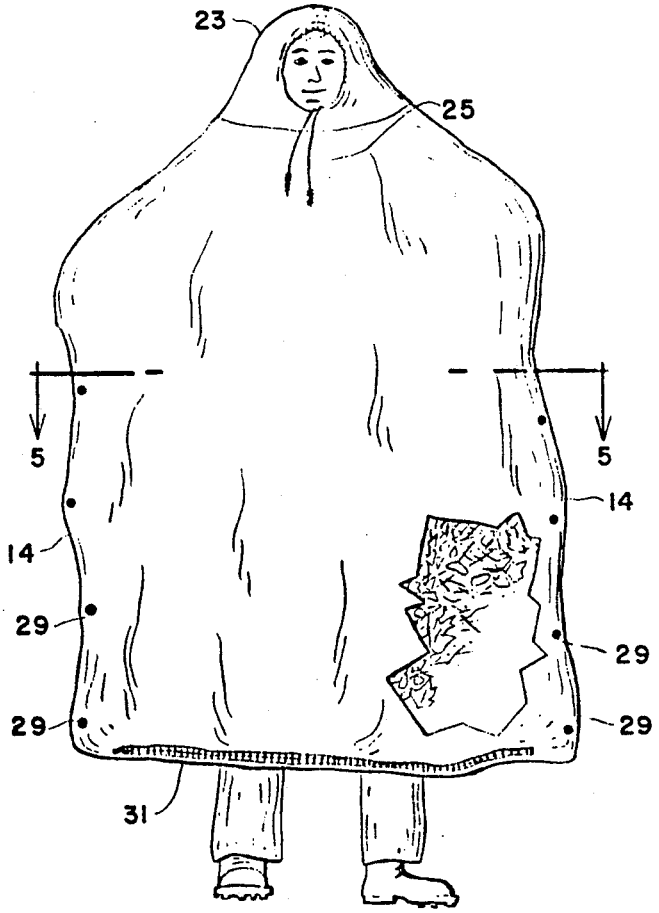
FIG. 4 is a front view of the device of FIG. 1 employed as an insulated poncho.
Figure 5:
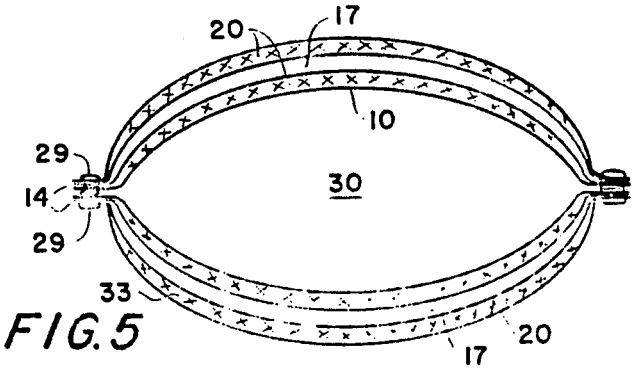
FIG. 5 is a sectional view taken in the direction of the arrows upon line 5—5 of FIG. 4.
Figure 6:
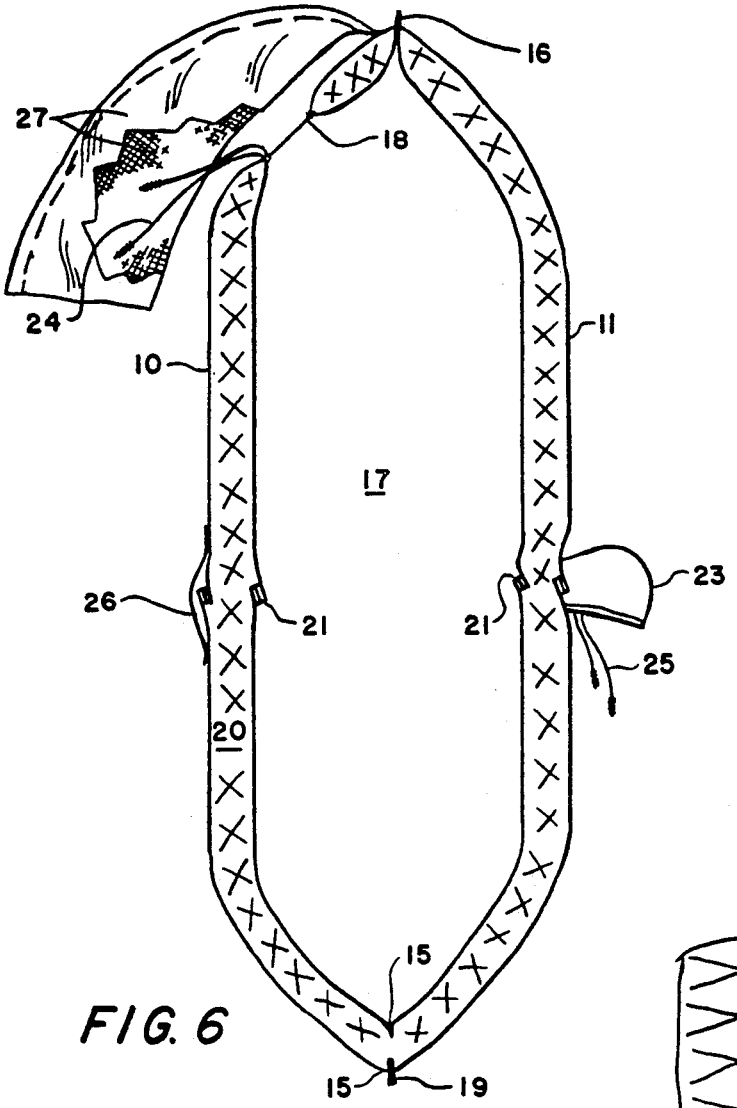
FIG. 6 is a sectional view taken in the direction of the arrows upon line 6—6 of FIG. 2, and showing the device in its sleeping bag mode of use.
Figure 7:
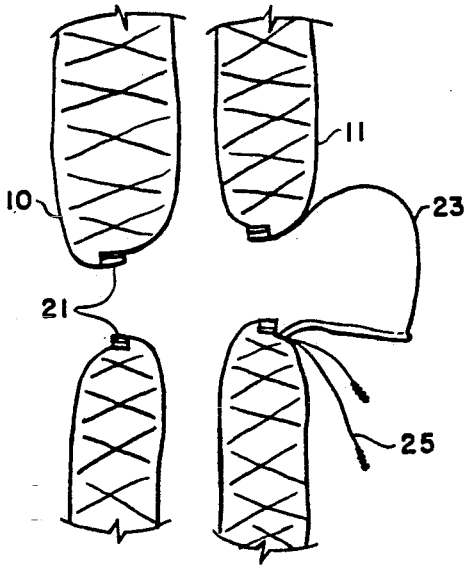
FIG. 7 is an enlarged fragmentary view of FIG. 6, showing the device in its poncho mode of use.

In another mode of use, as shown in FIG. 4, the enclosure device is folded about its midline 28 in a manner such that both halves of upper outer layer 10 disposed about said midline are in facing relationship. The resultant configuration is a poncho-style garment. Exterior bag 20 may optionally be filled with insulating material 33. The person causes his head to penetrate aligned slits 21 which constitute centered portal 35, pulls hood 23 over his head, and secures the hood by pulling and tying drawstring means 25. In this manner of use, there may be two layers of insulation disposed upon the front and rear of the person. Fastener means in the form of snap fasteners 29 are disposed along side edges 14. When the fasteners are interengaged, as shown in FIG. 5, a third enclosure 30 is produced which is open at the bottom 31. By suitable spacing of fasteners 29, openings in enclosure 30 may be created adjacent midline 28, thereby enabling the person's arms to emerge as though they were wearing a coat.

When not being used and empty of insulating material, the enclosure device can be folded or rolled into a compact, lightweight storage state approximately 6 inches by 6 inches by 3 inches and weighing approximately 1 pound 14 ounces. In such storage state, the device can be maintained for emergency use in automobiles, aircraft, or perilous locations, or can be readily distributed in time of need. The device can also be easily carried by campers, soldiers or others embarking upon potentially hazardous trips.

While particular examples of the present invention have been shown and described, it is apparent that changes and modifications may be made therein without departing from the invention in its broadest aspects. The aim of the appended claims therefore, is to cover all such changes and modifications as fall within the true spirit and scope of the invention.

What is claimed is:

1. A multi-functional enclosure device comprised of four layers of substantially elongated compliant thin sheet material having a predetermined shaped defined by opposed side edges and first and second end edges, said layers disposed one above the other as upper and lower outer layers and upper and lower inner layers with said side and end edges in facing alignment, the respective outer layers and inner layers being joined together along their side edges and second end edges, the two facing first end edges of said inner layers being bonded together to constitute the bottom extremity of an interior bag having an open top portal disposed upon said upper (outer) inner layer adjacent said second end edges, said upper outer layer also having an open top portal disposed adjacent said second edges and said respective open top portals are aligned with each other thereby defining an opening for the face of a human user or an opening for entry into said interior bag, the facing first end edges of said outer layers being joined to constitute the bottom extremity of an exterior bag that completely surrounds said interior bag, said interior bag having first closure means which permits entrance and removing of thermally insulating material into the space surrounding said interior bag.

2. The enclosure device of claim 1 dimensioned such that said interior bag can accommodate the entire length of a person in supine position.

3. The enclosure device of claim 1 having first drawstring means associated with the open top portal of said interior bag, thereby enabling said top portal to be drawn snugly about the user's facial perimeter.

4. The enclosure device of claim 1 wherein said four layers have aligned sealable slits positioned parallel to and midway between said end edges and centrally disposed between said side edges.

5. The enclosure device of claim 4 further comprising second closure means are associated with each sealable slit, enabling releasible engagement of the upper outer layer with the upper inner layer along both sides of said slits, and similarly enabling releasible engagement of the lower inner layer with the lower outer layer, such manner of releasible engagement forming a centered portal for insertion of the user's head in a poncho mode of use wherein the device is folded upon itself at a fold site centered along said slits.

6. The enclosure device of claim 5 wherein fastener means are disposed along said side edges and configured to interact when the device is folded upon itself, thereby forming a third enclosure whose upper extremity contains said centered portal and whose lower extremity is open.

7. A method of using a multi-functional enclosure device that has four layers of substantially elongated compliant thin sheet material having a predetermined shape defined by opposed side edges and first and second end edges, said layers disposed one above the other as upper and lower outer layers and upper and lower inner layers with said side and end edges in facing alignment, the respective outer layers and inner layers being joined together along their side edges and second end edges, the two facing first end edges of said inner layers being joined together to constitute the bottom extremity of an interior bag having an open top portal disposed upon said upper (outer) inner layer adjacent said second edges, said upper outer layer also having an open top portal disposed adjacent said second edges and said respective open top portals are aligned with each other thereby defining an opening for the face of a human user or an opening for entry into said interior bag, the facing first end edges of said outer layers being joined to constitute the bottom extremity of an exterior bag that completely surrounds said interior bag, said exterior bag having first closure means which permits entrance into the space surrounding said interior bag and the method comprises the following steps;

(a) opening said first closure means;

(b) filling the space between said exterior bag and said interior bag with naturally occurring material, such as fallen leaves, pine needles, moss, grass, and forest debris that can be collected and used as thermal insulation;

(c) slosing said first closure means.

8. A multi-functional enclosure device comprised of four layers of substantially elongated compliant thin sheet material having a predetermined shaped defined by opposed side edges and first and second end edges, said layers disposed one above the other as upper and lower outer layers and upper and lower inner layers with said side and end edges in facing alignment, the respective outer layers and inner layers being joined together along their side edges and second end edges, the two facing first end edges of said inner layers being bonded together to constitute the bottom extremity of an interior bag having an open top portal adjacent said second end edges, the facing first end edges of said outer layers being joined to constitute the bottom extremity of an exterior bag that completely surrounds said interior bag, said exterior bag having first closure means which permits entrance and removing of thermally insulating material into the space surrounding said interior bag, said four layers have aligned sealable slits positioned parallel to and midway between said end edges and centrally disposed between said side edges to form a centered portal for insertion of the user's head in the poncho mode of use.

* * * * *